US005447183A

United States Patent [19]

Derby

[11] Patent Number: 5,447,183

[45] Date of Patent: Sep. 5, 1995

[54] VACUUM FILL SYSTEM

[75] Inventor: Norwin C. Derby, Sherman, Tex.

[73] Assignee: B.A.G. Corp., Dallas, Tex.

[21] Appl. No.: 185,035

[22] Filed: Dec. 13, 1993

Related U.S. Application Data

[63] Continuation of Ser. No. 896,599, Jun. 10, 1992, abandoned, which is a continuation-in-part of Ser. No. 643,704, Jan. 22, 1991, abandoned, which is a continuation of Ser. No. 407,901, Sep. 15, 1989, abandoned.

[51] Int. Cl.[6] ..... B65B 1/26

[52] U.S. Cl. ..... 141/67; 141/59; 141/65; 141/71; 141/314

[58] Field of Search ..... 222/152, 216, 252, 367, 222/368, 442, 450, 452, 636, 637; 414/217, 219–221; 141/65, 67, 68, 71, 73, 80, 5, 8, 10–12, 98, 114, 313–317, 7, 59, 250–252, 263, 284, 390–392; 248/95, 97–99; 383/107, 122

[56] References Cited

U.S. PATENT DOCUMENTS

| | | | |
|---|---|---|---|
| 2,138,356 | 11/1938 | Ryan et al. . | |
| 2,142,990 | 1/1939 | Belcher . | |
| 2,381,454 | 8/1945 | Huth | 141/59 |
| 2,720,375 | 10/1955 | Carter . | |
| 2,780,247 | 2/1957 | Claassen | 141/7 |
| 2,783,786 | 3/1957 | Carter | 141/51 |
| 2,815,621 | 12/1957 | Carter . | |
| 2,964,070 | 12/1960 | Linhardt | 141/7 |
| 3,063,477 | 11/1962 | Vogt | 141/5 |
| 3,232,494 | 2/1966 | Poarch . | |
| 3,258,041 | 6/1966 | Lau | 141/10 |
| 3,260,285 | 7/1966 | Vogt | 141/8 |
| 3,406,727 | 10/1968 | Rexus | 141/314 |
| 3,542,091 | 11/1970 | Carter | 141/65 |
| 3,586,066 | 6/1971 | Brown | 141/5 |
| 3,589,411 | 6/1971 | Vogt | 141/71 |
| 3,605,826 | 9/1971 | Carter | 141/5 |
| 3,719,318 | 3/1973 | Moran | 383/107 X |
| 3,785,410 | 1/1974 | Carter | 141/10 |
| 3,788,368 | 1/1974 | Geng et al. | 141/67 |
| 3,822,037 | 7/1974 | Long | 383/107 X |
| 3,847,191 | 11/1974 | Aronson | 141/12 |
| 3,989,073 | 1/1976 | Remmert | 141/315 |
| 4,060,183 | 11/1977 | Puurunen | 222/442 |
| 4,182,386 | 1/1980 | Alack | 141/83 |
| 4,185,669 | 1/1980 | Jevakohoff | 141/59 |
| 4,219,054 | 8/1980 | Carter et al. | 141/10 |
| 4,457,125 | 7/1984 | Fishburne | 141/80 |
| 4,521,911 | 6/1985 | Vance | 383/122 X |
| 4,526,214 | 7/1985 | McGregor | 141/59 |
| 4,545,410 | 10/1985 | Paul et al. | 141/18 |
| 4,573,504 | 3/1986 | Rosenstrom | 141/59 |
| 4,614,213 | 9/1986 | Englin | 141/59 |
| 4,648,432 | 3/1987 | Mechalas | 141/68 |
| 4,825,913 | 5/1989 | Stott | 141/59 |
| 4,854,353 | 8/1989 | Russell | 141/74 |
| 4,872,493 | 10/1989 | Everman | 141/59 |
| 4,912,681 | 3/1990 | Halsey et al. . | |
| 4,963,172 | 10/1990 | De Marco | 141/59 X |
| 5,109,893 | 5/1992 | Derby | 141/67 |

FOREIGN PATENT DOCUMENTS

| | | | |
|---|---|---|---|
| 1265286 | 5/1961 | France | 141/10 |
| 0483381 | 4/1938 | United Kingdom | 383/107 |

*Primary Examiner*—J. Casimer Jacyna
*Attorney, Agent, or Firm*—Michael A. O'Neil

[57] ABSTRACT

A vacuum fill system for deaerating and compacting flowable materials within a container for transportation and storage of the materials includes a hollow chamber having an open bottom end for insertion of the chamber into the container. A rubber pad placed under the container seals the chamber for creation of a vacuum in the chamber through a vacuum line connecting the chamber to a vacuum source for deaeration of flowable materials placed within the chamber and the container. A line having a valve therein and vented to the atmosphere is connected to the chamber for returning the chamber to atmospheric pressure substantially instantaneously to compact the deaerated material into a substantially solid mass within the container. Upon completion of compaction the chamber of the vacuum fill system is removed from the interior of the container and the top of the container closed for shipment or storage.

4 Claims, 5 Drawing Sheets

VACUUM FILL SYSTEM

RELATED APPLICATION

This Application is a "file-wrapper continuation of U.S. application Ser. No. 07/896,599, filed Jun. 10, 1992, now abandoned, which is a continuation-in-part of U.S. application Ser. No. 07/643,704, filed Jan. 22, 1991, now abandoned, which is a file-wrapper continuation of application Ser. No. 07/407,901, filed Sep. 15, 1989, now abandoned.

TECHNICAL FIELD

This invention relates to a vacuum fill system for deaerating flowable materials for storage and transportation in a container, and in particular to a vacuum fill system for insertion into a container for deaerating and compacting flowable materials after they are placed in the container.

BACKGROUND OF THE INVENTION

Containers used in the storage, transportation, and dispensation of flowable materials have been around for as long as civilization itself. The use of such containers, however, has always been limited by (1) the weight, density, and other physical properties of the material being stored, and (2) by the process and type of container used to store the material.

Traditional filling processes and containers have long been encumbered by a simple phenomenon that has exasperated consumers for decades—settling. Settling, as any purchaser of a bag of potato chips knows, means the bag is never completely filled when opened. This occurs due to the settling of the product inside during its filling and shipment. This simple settling phenomenon causes tremendous economic waste each year because of the misuse of storage space and container materials. This has been particularly true in the storage, transportation, and dispensation of flowable materials in semi-bulk quantities such as grains, chemicals and other bulky substances stored in flexible, bulk containers, such as those disclosed in U.S. Pat. Nos. 4,143,796 and 4,194,652.

It has long been known that the settling process is caused by the natural aeration of flowable materials as the materials are placed inside a container. As the container is shipped to its final destination, the air escapes from the aerated material mixture causing the product to compact and reduce in volume. Thus, when the container is opened, the flowable material has settled to the bottom of the container, i.e. the bag of potato chips is only half full.

Any process or system, such as the present invention, for storing materials in a container for shipment that allows all of the container to be filled with product and eliminates the excess air results in an enormous cost savings. Indeed, the shipment of smaller sized containers using vacuum sealed packages such as, e.g., vacuum sealed coffee containers, has alleviated many of the above problems of cost and time.

Although vacuum sealed packaging has proved to be an efficient, cost-saving and consumer pleasing method of shipping small quantities of goods, before now, it has been impossible to apply such techniques into other areas of storage, transportation and dispensation of flowable materials. This has been particularly true in the market for semi-bulk flowable materials.

The present invention, however, substantially eliminates settling and the inherent problems associated therewith by providing a vacuum fill system that deaerates the flowable material during filling. The present invention thus allows more product to be transported in the same size container than is possible using prior techniques.

Additionally, by utilizing all of the container space, the present invention allows for the far more efficient total use of all of the container materials and space. No longer is money being spent for container material that is not used. Therefore, the present invention overcomes many of the difficulties inherent in prior fill systems.

SUMMARY OF THE INVENTION

The present invention relates to a vacuum fill system for deaerating flowable materials, and in particular, to a vacuum fill system for use with containers, including flexible intermediate bulk containers, for storing, transporting, and dispensing flowable materials in semi-bulk quantities.

The vacuum fill system of the present invention generally comprises a solid, air impermeable base supporting a rubber pad on which a flexible intermediate bulk container is placed. A rigid vacuum chamber open at the bottom is inserted into the container with the bottom of the container separating the open bottom of the rigid vacuum chamber from the rubber pad.

Flowable material is then placed into the vacuum chamber, thereby filing the container. A vacuum is created in the vacuum chamber to deaerate the flowable material such that the particles are suspended within the rigid vacuum chamber. A vent to the atmosphere is then opened to return the contents of the vacuum chamber to atmospheric pressure substantially instantaneously, thereby compacting the suspended particles of deaerated material into a near solid mass. The process is repeated until the compacted material reaches a predetermined height in the container. The vacuum chamber is then removed from the container and the container sealed for storage or transportation. Because the flowable material is deaerated and compacted within the container, the possibility of reaerating the compacted material as it is placed into the container, as in prior art vacuum fill systems, is reduced.

The vacuum chamber may be approximately the same height as the flexible bulk container, thereby having substantially the same interior capacity as the container. Alternatively, the rigid vacuum chamber may be substantially greater in height than the container. The greater the height of the chamber, the greater the quantity of flowable material deaerated and compacted with each cycle, thereby resulting in fewer cycles required to fill the container to the predetermined level.

Not only does the vacuum fill system of the present invention provide for greater utilization of flexible bulk container materials, space, and time, but also reduces the chance of possible reaeration of the compacted material by eliminating the step of transferring the compacted material from a compaction chamber to the container. Thus, the present invention has numerous advantages over the prior art.

BRIEF DESCRIPTION OF THE DRAWINGS

A more complete understanding of the invention may be had by reference to the following Detailed Description when taken in conjunction with the accompanying Drawings, in which.

DETAILED DESCRIPTION OF THE DRAWINGS

Figures 1, 2, 3:
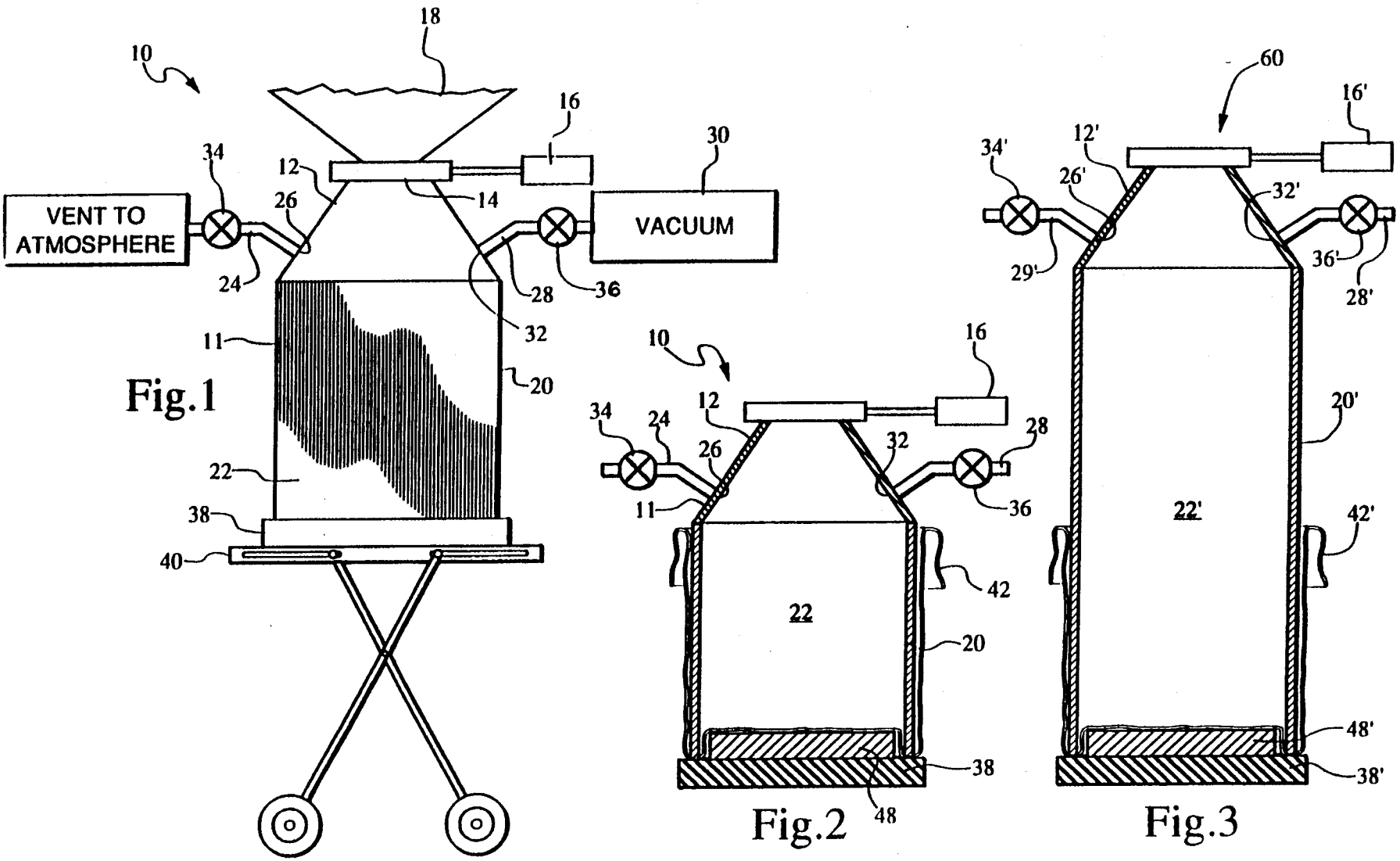
FIG. 1 is a front view of a first embodiment incorporating the vacuum fill system of the present invention.
FIG. 2 is a sectional view of the vacuum fill system of FIG. 1.
FIG. 3 is a sectional view of a second embodiment incorporating the vacuum fill system of the present invention.

Referring now to the Drawings, and in particular to FIG. 1, there is shown a first embodiment 10 incorporating the vacuum fill system of the present invention. The vacuum fill system 10 has a chamber 11 having an upwardly tapered top wall 12 with an opening 14 therein for the passage of flowable materials therethrough. A valve 16, preferably a knife or slide gate valve, is attached to the top wall 12 to regulate the flow of materials through the opening 14 and to seal the opening 14 to allow creation of a vacuum in the chamber 11. Flowable materials may be received through opening 14 by means of a hopper 18 as shown in FIG. 1, or any other flowable material dispensing apparatus.

The top wall 12 flares outwardly and downwardly for attachment to a perimeter sidewall 20 defining an interior chamber area 22. A line 24, vented to the atmosphere, communicates with the interior chamber area 22 through an opening 26 in the top wall 12 of the chamber 11. A line 28 connects a vacuum source 30 to the interior chamber area 22 through an opening 32 in the top wall 12 of the chamber 11. A valve 34 in the line 24 closes to allow a vacuum to be created in the interior chamber area 22. Opening of valve 34 returns the interior chamber area 22 to atmospheric pressure substantially instantaneously. Likewise, a valve 36 in line 28 is opened to allow the creation of a vacuum in the interior chamber area 22, and may be opened or closed when opening valve 34 to return the interior chamber area 22 to atmospheric pressure.

The perimeter sidewall 20 is not attached to a bottom wall. Therefore, to form a seal necessary to create a vacuum in the interior chamber area 22, the chamber 11 is positioned over and supported by a rubber pad 38 having an exterior perimeter slightly larger than the exterior perimeter of the sidewall 20. The rubber pad 38 is in turn supported by an air impermeable base 40 which may be anything from a fixed surface to a portable surface, as shown in FIG. 1.

Figure 4:
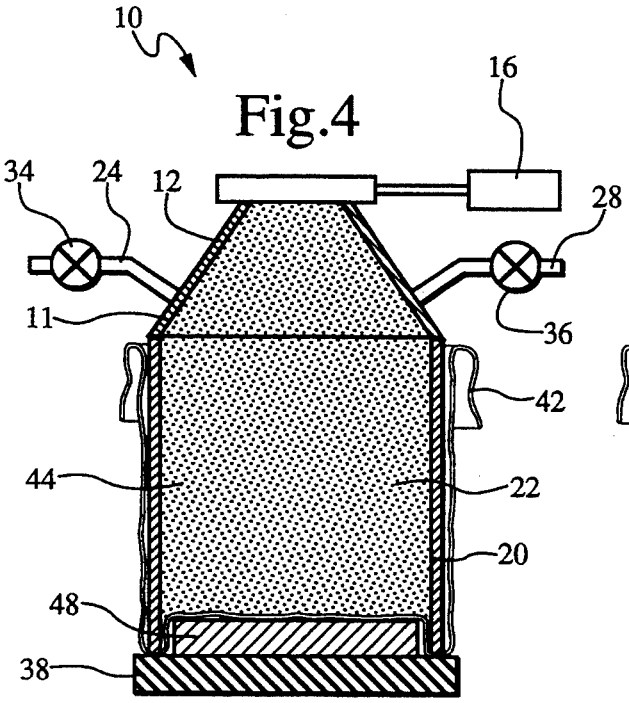
FIG. 4 is a view similar to FIG. 2 showing the vacuum fill system filled with flowable material.
Figure 6:
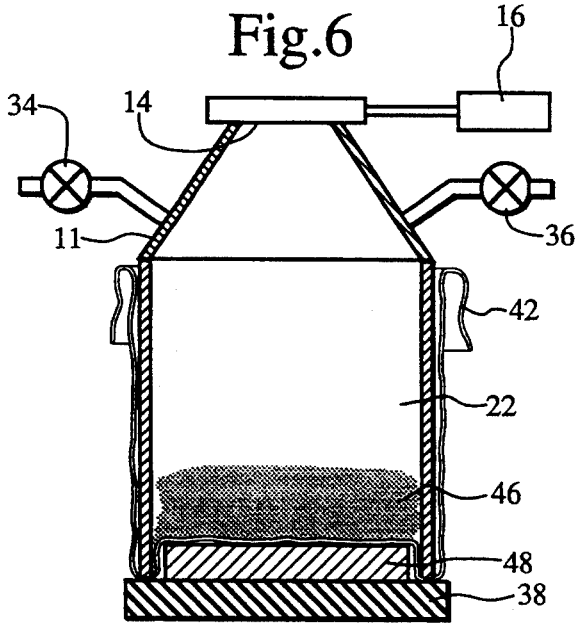
FIG. 6 is a view similar to FIG. 4 showing the flowable material after deaeration and compaction.

Referring now to FIGS. 2, 4, and 6, there is illustrated the operation of the vacuum fill system 10. When densifying flowable materials for storage in a flexible intermediate bulk container 42, the container 42 is positioned over the rubber pad 38 and the chamber 11 of the vacuum fill system 10 is inserted into the interior of the container 42 as shown in FIG. 2. The valve 16 is opened and flowable material 44 is received into the chamber 11 of the vacuum fill system 10, as shown in FIG. 4. Valve 34 is closed, valve 16 closed, and valve 36 opened to create a vacuum in the interior chamber area 22 to remove excess air from the flowable material 44. When the pressure within the interior chamber reaches a predetermined level, valve 36 is closed and valve 34 opened simultaneously to return the interior chamber area 22 to atmospheric pressure substantially instantaneously to compact the deaerated material to a near solid mass 46, as shown in FIG. 6.

Referring still to FIGS. 2, 4, and 6, when valves 16 and 34 are closed and valve 36 opened to create a vacuum in the interior chamber area 22, the sidewall 20 will, in some cases, tend to pull inwardly. To prevent possible deformation of the sidewall 20, a support plate 48 having the same shape as the sidewall 20, but with an exterior perimeter slightly smaller than the interior perimeter of the sidewall 20 is placed under the container 42 prior to insertion of the chamber 11 into the container 42. Thus, the support plate is supported on the rubber pad 38 and rests under the container 42, but within the interior chamber area 22. The support plate 48 may be made of any number of strong metal or plastic materials.

Figure 5:
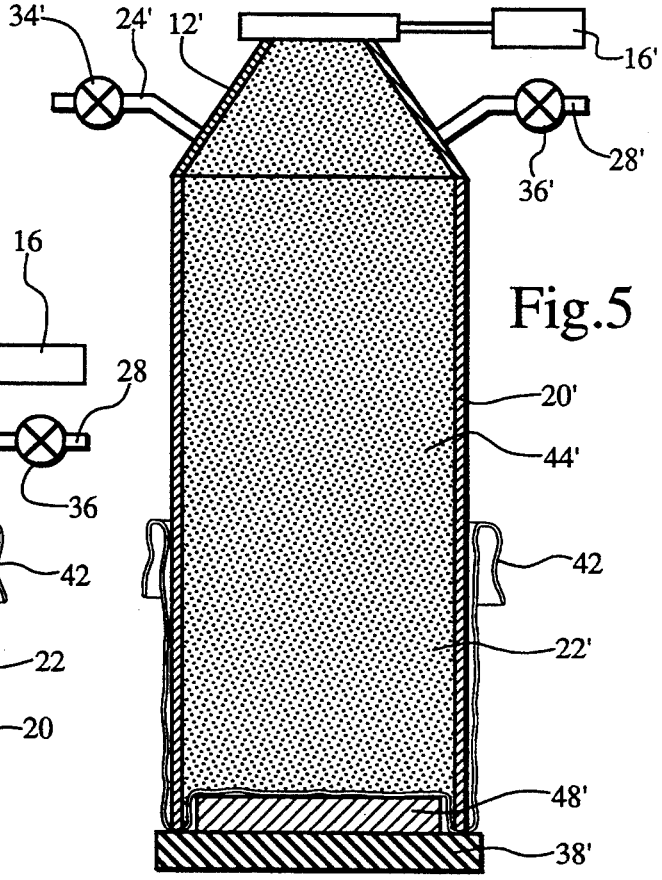
FIG. 5 is a view similar to FIG. 3 showing the vacuum fill system filled with flowable material.
Figure 7:
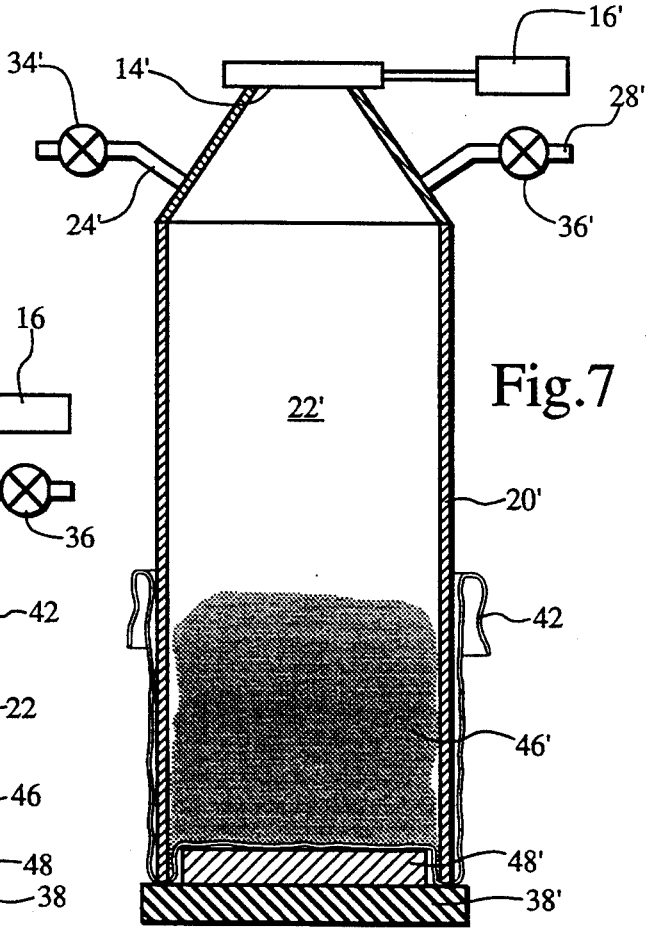
FIG. 7 is a view similar to FIG. 5 showing the flowable material after deaeration and compaction.

Referring now to FIGS. 3, 5, and 7, there is shown a second embodiment 60 of the vacuum fill system of the present invention, wherein reference numerals referring to elements similar to those of FIGS. 2, 4, and 6, are differentiated by a prime "'" designation. As shown in FIGS. 3, 5, and 7, the vacuum fill system 60 has an interior chamber area 22' substantially larger than that of the first embodiment vacuum fill system 10. Thus, the interior chamber area 22' can receive more flowable material 44', thereby deaerating and compacting more material into a larger near solid mass of material 46', as shown in FIG. 7.

As illustrated in FIGS. 2, 4, and 6, the cycle of depositing flowable material into the chamber 11, creating a vacuum in the chamber 11, and returning the interior chamber area 22 to atmospheric pressure to compact the material 44 must be repeated several times until the near solid mass 46 reaches the desired level in the container 42. As illustrated in FIGS. 3, 5, and 7, the cycle for deaerating and compacting the material must be repeated fewer times for the near solid mass of material 46' to reach the desired level in the container 42'.

Figure 8:
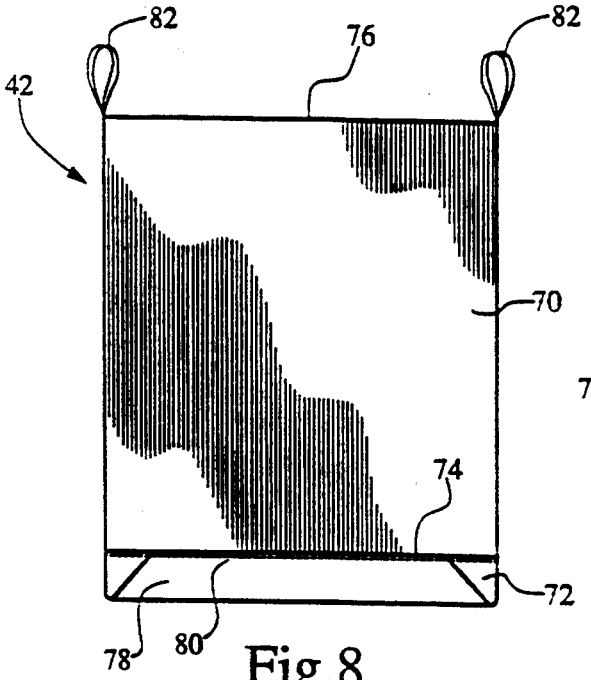
FIG. 8 is a front view of a first embodiment of a flexible intermediate bulk container with a modified bottom seam for use with the vacuum fill system of FIGS. 1 and 3.
Figure 9:
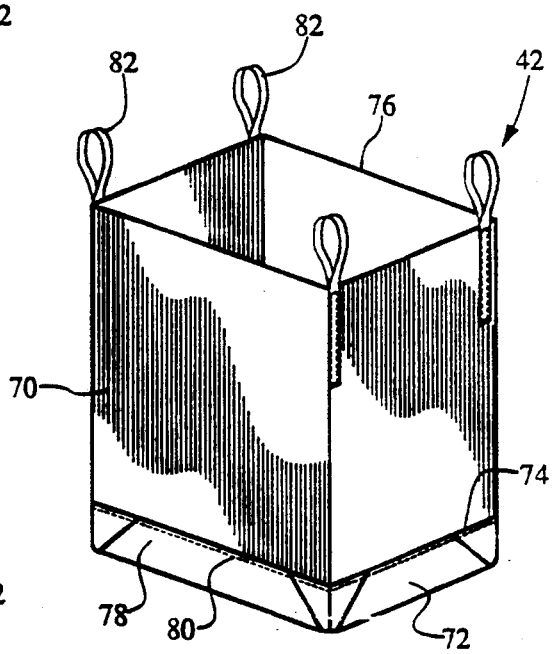
FIG. 9 is an isometric view of the flexible intermediate bulk container of FIG. 8.

Referring now to FIGS. 8 and 9, there is shown a container 42 for use with the vacuum fill system 10 and 60. The container 42 has a sidewall 70 and a bottom wall panel 72. The sidewall panel 70 may be formed of a single panel stitched along opposing ends to form a tube or may be made of a plurality of side panels stitched together along adjacent side seams to form the sidewall 70 having a first end 74 and a second end 76.

The bottom wall panel is pleated at the corners causing a predetermined length of the bottom wall panel 72 around the entire perimeter of panel 72 to extend upwardly. The upwardly extending portion 78 is then seamed to the container sidewall 70 along the first end 74 of the container sidewall 70. Thus, when the bottom panel 72 is seamed to the sidewall 70 the upwardly extending portion 78 of the bottom wall panel 72 forms a portion of the sidewall 70.

It has been discovered that positioning of a seam between the sidewall 20 of the chamber 11 and the rubber pad 38 prevents the formation of a sufficient seal to allow creation of a vacuum within the interior chamber area 22. The configuration of the container 42 as shown in FIGS. 8 and 9, when used with the vacuum fill system 10 and 60, prevents the seam 80 connecting the bottom panel 72 to the sidewall 70 from being positioned between the sidewall 20 of the chamber 11 and the rubber pad 38.

Upon completion of a sufficient number of cycles to complete the fill process, the chamber 11 of the vacuum fill system 10 is removed from the container 42. The container is then sealed by folding over the second end 76 of the sidewall 70 or by gluing or attaching a top wall to the second end 76 of the sidewall 70. Lift straps 82 attached to the sidewall 70 are used to lift and transport the filled container. The straps are attached a predetermined distance from the second end 76 of the sidewall 70 to allow the second end 76 to be folded over and sealed.

The bottom wall panel 72 may be of any configuration including, but not limited to square, rectangular, or any other configuration capable of receiving the sidewall 20 of the chamber 11 therein. Likewise, the sidewall 20 of the chamber 11 may be of any number of configurations including, but not limited to, square, rectangular, or circular.

Figure 10:
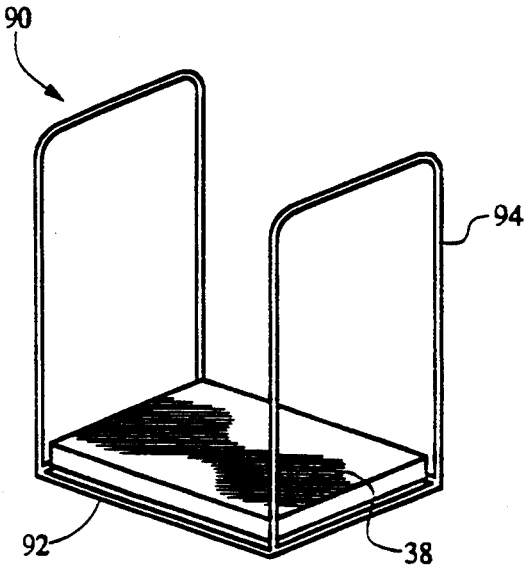
FIG. 10 is an isometric view of a frame for supporting a flexible intermediate bulk container for use with the vacuum fill system of FIGS. 1 and 3.

Referring now to FIG. 10, there is shown a frame 90 for supporting the container 42 in an upright position during the fill process. The frame 90 has an open perimeter base 92 for placement of the frame 90 over the rubber pad 38 such that the perimeter base 92 surrounds the rubber pad 38. Attached to the perimeter base 92 and extending upwardly therefrom are a pair of opposed side arm supports 94.

Figure 12:
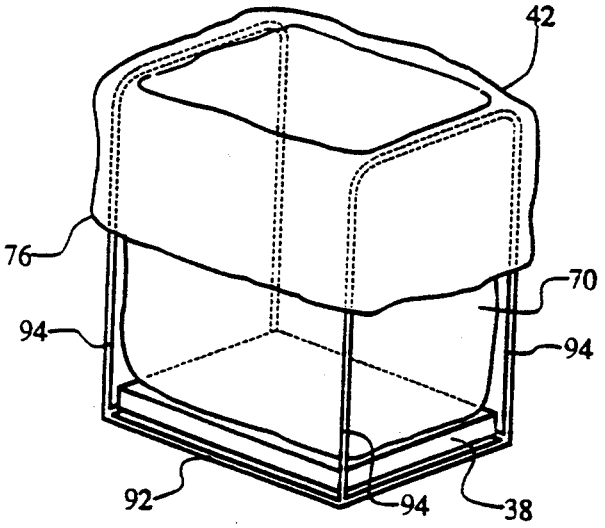
FIG. 12 is an isometric view of a flexible intermediate bulk container supported on the frame of FIG. 10.

Referring now to FIG. 12, during the fill process, the second end 76 of the container 42 is folded over the side arm supports 94 of the frame 90 such that the bottom panel of the container 42 rests on the rubber pad 38. Thus, the container 42 is held in an upright position during the fill process.

Figure 11:
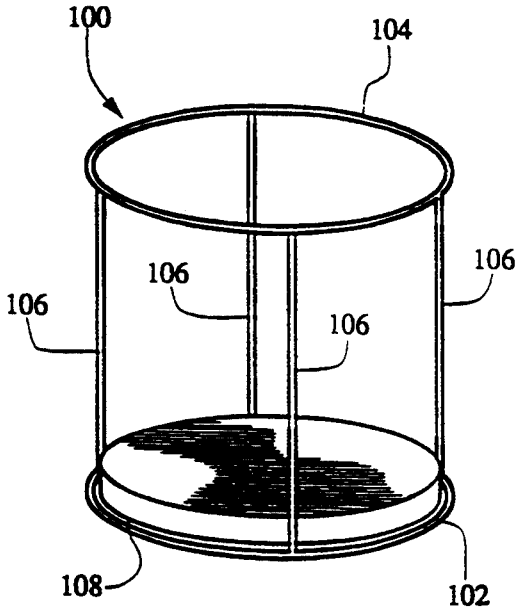
FIG. 11 is an isometric projection view of a frame for supporting a substantially round flexible intermediate bulk container for use with the vacuum fill system of FIGS. 1 AND 3.
Figure 13:
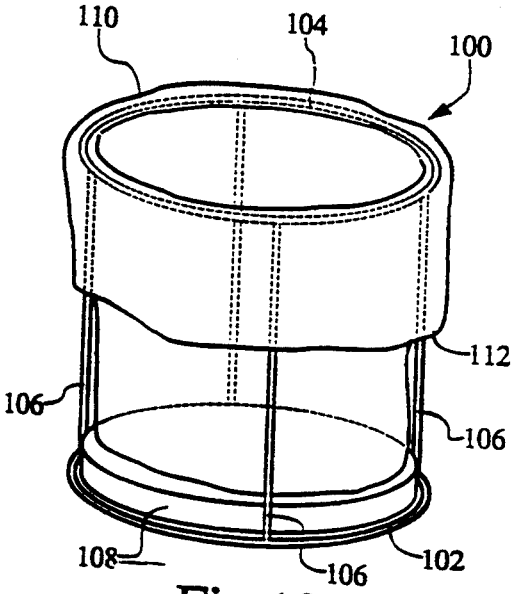
FIG. 13 is an isometric view illustrating a flexible intermediate bulk container supported on the frame of FIG. 11.
Figure 14:
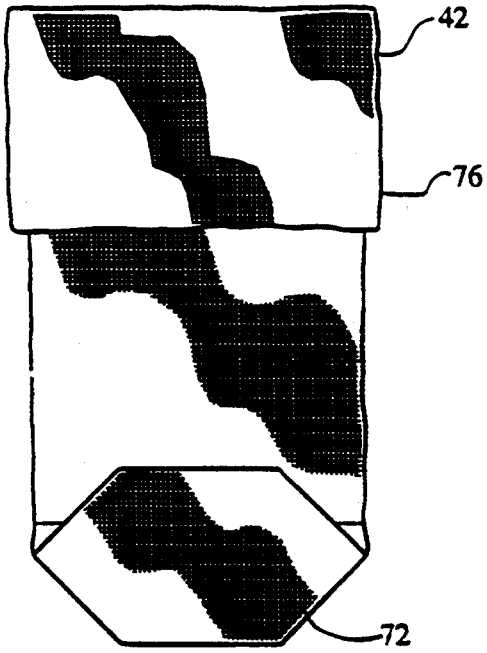
FIG. 14 is a front view illustrating the folding of the container of FIG. 8 for storage prior to use.

Referring now to FIGS. 11 and 13, there is shown a second embodiment frame 100 having an open, circular, perimeter base 102, a circular, perimeter support ring 104, and spaced apart support arms 106 attached to and extending vertically between the circular base 102 and the circular ring 104. The configuration of the circular support frame 100 allows the frame to be positioned to surround a circular rubber pad 108 for supporting a circular container 110 in an upright position during the fill process. As illustrated in FIG. 13, the top edge 112 of the circular container 110 is folded over the circular support ring 104 for retaining the container 110 in an upright position during the fill process.

Referring now to FIGS. 14, 15, 16, and 17, for ease of storage and ready use of the containers 42 and 110, the container may be folded and stored as illustrated in FIGS. 14, 15, 16, and 17, with the bottom panel 72 of the container 42 and the bottom panel 114 of the circular container 110 folded upwardly on one side and downwardly on the other side such that one side of the containers 42 and 110 and the bottom panels 72 and 114, respectively, face upwardly. The top edges 76 and 112 of the containers 42 and 110, respectively, are turned downwardly a predetermined distance for proper placement over the frames 90 and 100, respectively, during the fill process. Thus, containers may be simply retrieved and inserted into position on the frames 90 and 100 to begin the fill process.

Figure 15:
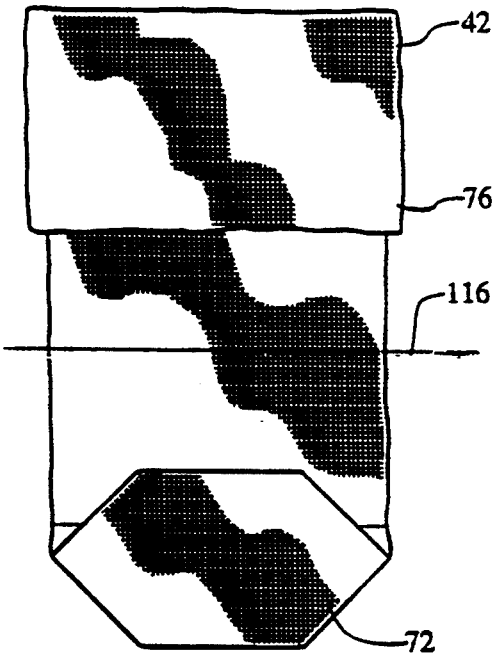
FIG. 15 is a view similar to FIG. 14 further illustrating a center-fold line for further folding the container of FIG. 8.
Figure 16:
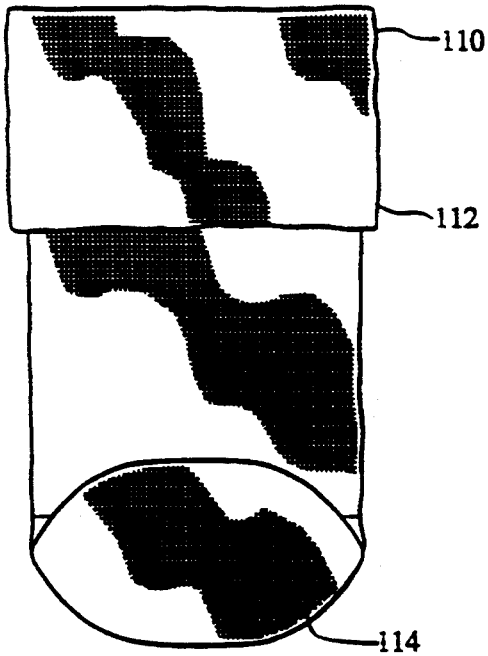
FIG. 16 is a front view of a second embodiment of the flexible intermediate bulk container of FIG. 8 folded for storage prior to use.
Figure 17:
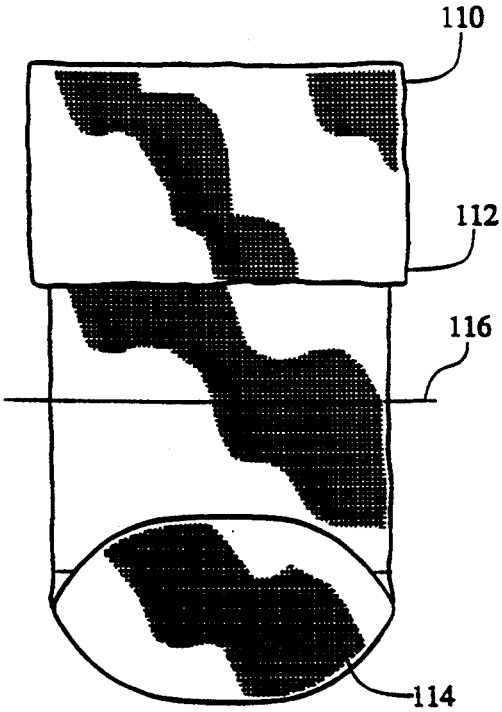
FIG. 17 is a view similar to FIG. 16 further illustrating a center-fold line for further folding of the container of FIG. 16 for storage.

The containers 42 and 110 may further be folded in half, as shown in FIGS. 15 and 17, along a fold line indicated by broken line 116 for storage of the containers in smaller areas.

Although preferred embodiments of the present invention have been illustrated in the accompanying Drawings and described in the foregoing Detailed Description, it will be appreciated by those skilled in the art that various modifications and rearrangements of the component parts and elements of the present invention are possible within the scope of the present invention.

I claim:

1. A vacuum fill system for deaerating and compacting flowable material for storage and transportation in flexible bulk containers comprising:
- a base for supporting the flexible bulk container wherein the base is positioned below the container;
- a hollow chamber having a sidewall, a top wall, and an open bottom;
- means for inserting the hollow chamber into the container;
- means for creating a vacuum in the chamber to deaerate the flowable material in the container;
- means for returning the chamber contents to atmospheric pressure substantially instantaneously to compact the deaerated material; and
- means for forming an airtight seal at the open bottom of the chamber for creating a vacuum in the chamber wherein said means comprises a rubber pad supported on the base under the open bottom of the chamber and having a diameter larger than the diameter of the chamber.

2. A vacuum fill system for deaerating and compacting flowable material for storage and transportation in flexible bulk containers comprising:
- a container having sidewalls and a bottom wall for receiving flowable materials therein;
- an air impermeable base for supporting the container; wherein the base is positioned below the container;
- a hollow chamber having a sidewall, a top wall, and an open bottom;
- means for inserting the hollow chamber into the container;
- means for forming an airtight seal at the open bottom of the chamber wherein said means further comprises a rubber pad placed on the base, under the container and under the chamber;

a sealable opening in the top wall of the chamber for movement of flowable material into the chamber;

means for creating a vacuum in the chamber;

means for returning the chamber contents to atmospheric pressure substantially instantaneously; and means for preventing collapse of the chamber in the area of the open bottom when the vacuum is created in the chamber.

3. A vacuum fill system for deaerating and compacting flowable material for storage and transportation in flexible bulk containers comprising:

a base for supporting the flexible bulk container;

a hollow chamber having a sidewall, a top wall, and an open bottom for insertion into the container;

means for creating a vacuum in the chamber to deaerate the flowable material in the container;

means for returning the chamber contents to atmospheric pressure substantially instantaneously to compact the deaerated material;

means for retaining the shape of the open bottom of the chamber when a vacuum is created in the chamber, wherein said means for retaining the shape of the open bottom of the chamber further comprises a metal disk supported on the rubber pad and placed under the container within the sidewall of the chamber and, the metal disk having a diameter slightly smaller than the interior diameter of the chamber.

4. A vacuum fill system for deaerating and compacting flowable material for storage and transportation in flexible bulk containers comprising:

a container having sidewalls and a bottom wall for receiving flowable materials therein;

an air impermeable base for supporting the container;

a hollow chamber having a sidewall, a top wall, and an open bottom for insertion into the container;

means for forming an airtight seal at the open bottom of the chamber;

a sealable opening in the top wall of the chamber for movement of flowable material into the chamber;

means for creating a vacuum in the chamber;

means for returning the chamber contents to atmospheric pressure substantially instantaneously; and means for preventing collapse of the chamber in the area of the open bottom when the vacuum is created in the chamber, wherein said means for preventing collapse of the chamber in the area of the open bottom further comprises a metal disk supported on the rubber pad and placed under the container within the sidewall of the chamber and, the metal disk having a diameter slightly smaller than the interior diameter of the chamber.

* * * * *

UNITED STATES PATENT AND TRADEMARK OFFICE

CERTIFICATE OF CORRECTION

PATENT NO. : 5,447,183

DATED : September 5, 1995

INVENTOR(S) : Norwin C. Derby

It is certified that error appears in the above-indentified patent and that said Letters Patent is hereby corrected as shown below:

On the title page, item [63]

"Continuation of Ser. No. 896,599, Jun. 10, 1992, abandoned, which is a continuation-in-part of Ser. No. 643,704, Jan. 22, 1991, abandoned, which is a continuation of Ser. No. 407,901, Sep. 15, 1989, abandoned." is deleted and replaced with --File wrapper continuation of Ser. No. 896,599, Jun. 10, 1992, co-pending, now abandoned, which is a continuation-in-part of Ser. No. 875,587, Apr. 28, 1992, abandoned, which is a file wrapper continuation of Ser. No. 643,704, Jan. 22, 1991, abandoned, which is a continuation of Ser. No. 407,901, Sept. 15, 1989, abandoned.--

Signed and Sealed this

Eleventh Day of August 1998

Bruce Lehman

*Attest:*

BRUCE LEHMAN

*Attesting Officer*

*Commissioner of Patents and Trademarks*